United States Patent [19]

Stenudd

[11] 3,968,867

[45] July 13, 1976

[54] INFORMATION TRANSMISSION DEVICE FOR POINT CONTACT ON AN INFORMATION CARRIER

[75] Inventor: Sven Gunnar Valter Stenudd, Lidingo, Sweden

[73] Assignee: Facit Aktiebolag, Atvidaberg, Sweden

[22] Filed: July 15, 1974

[21] Appl. No.: 488,806

[52] U.S. Cl. ..... 197/1 R; 101/93.04

[51] Int. Cl.[2] ..... B41J 3/50

[58] Field of Search ..... 197/1 R; 101/93.33, 101/93.34, 93.32, 93.03, 93.04, 93.05

[56] References Cited

UNITED STATES PATENTS

| | | | |
|---|---|---|---|
| 3,386,378 | 6/1968 | Bradbury et al. | 197/1 R X |
| 3,828,908 | 8/1974 | Schneider | 197/1 R |
| 3,836,880 | 9/1974 | Matschke et al. | 197/1 R X |
| 3,842,955 | 10/1974 | Iwasaki | 197/1 R |
| 3,854,564 | 12/1974 | Flaleliere et al. | 197/1 R |

*Primary Examiner*—Ralph T. Rader
*Attorney, Agent, or Firm*—Alfred E. Miller

[57] ABSTRACT

An arm in an information transmission device having a device for printing or punching holes in an information carrier. The arm is light weight, occupies less space, and operates at a higher speed than known devices of the same type. The arm is supported by a spring element and is adopted for use with an electromagnet whereby the arm is resiliently pivotable toward and away from the carrier in order to punch or print information on the carrier.

4 Claims, 4 Drawing Figures

INFORMATION TRANSMISSION DEVICE FOR POINT CONTACT ON AN INFORMATION CARRIER

BACKGROUND OF THE INVENTION

This invention relates to a device for pointwise action on an information carrier, for instance for punching holes or printing characters composed by dots, dashes or the like, including means, such as a pointed head, a needle or the like, acting on the carrier and intended to strike on or press against a surface of the carrier.

In known character printing devices of the type referred to the printing members, which may comprise long threads, are generally operated by elongated electromagnets. The threads run in elongated guide means. These devices have several disadvantages. Because of the relatively large mass of the moving parts and also due to friction in the guide means the printing velocity is not very high. Moreover, by the elongated operating means the devices will have a considerable depth perpendicularly to a writing surface. Further, known devices for punching holes are space consuming and are characterized by a large moving mass and of considerable friction in bearings and the like.

The object of the present invention is to provide a device which operates at a higher speed and occupies considerably less space than the known devices. A device according to the invention is mainly characterized by a long arm which is disposed generally parallel to the surface and one end of which has the shape of or has a member acting on the carrier, its other end being associated with a spring element, the arm under the action of operating means being resiliently pivotable towards or away from the surface.

In a preferred embodiment of the invention the arm is associated with an armature energized by an electromagnet, which is arranged to receive electric pulses controlling the punching or the printing operation.

By the invention it is possible to use electromagnets of a construction which permits a very light armature. Also the arm can be of a very light material. Since the arm is supported by a spring element the friction during the turning movement of the arm can be entirely disregarded. Furthermore, a device according to the invention has no bearing which could be exposed to wear. It is also possible according to the invention to locate the greatest part of the moving mass close to the centre of pivoting so that the action of the mass as a bar to acceleration is reduced to a minimum.

Additional characterizing features and advantages of the invention will be seen in the following description in which reference is made to the attached drawings.

BRIEF DESCRIPTION OF THE EMBODIMENTS

In the drawings, FIG. 1 is a top plan of an arm with a spring element and FIG. 2 shows the same arrangement in a cross section on the line II—II of FIG. 1. FIG. 3 is a cross section of an embodiment of a device according to the invention and FIG. 4 shows schematically another embodiment of the invention. Corresponding details in the different Figures have the same reference numerals.

DESCRIPTION OF THE PREFERRED EMBODIMENTS

Figure 1:
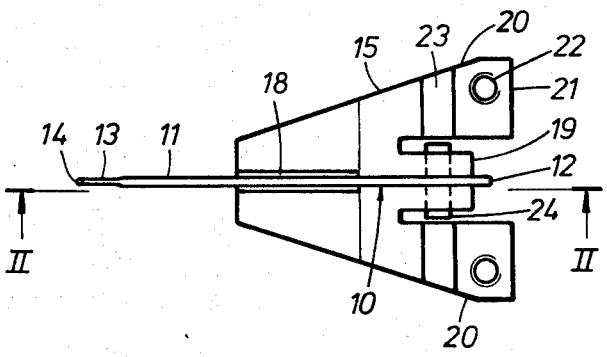
Figure 2:
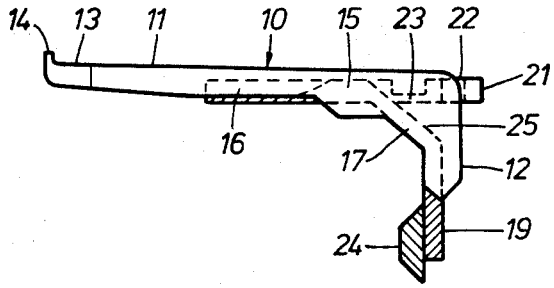

FIGS. 1 and 2 show by way of example an arm 10 bent to an angle so as to form two legs 11 and 12. The outer end of the leg 11 has a narrow portion 13 with a punching or printing tip 14 preferably of hard carbide steel. The arm 10 is associated with a leaf spring 15 and is accomodated in grooves 16 and 17 therein. As shown in FIG. 1 the groove 16 has elevated edges 18.

The leaf spring 15 comprises a central portion 19 in which the groove 17 is made. Also that part of the leaf spring which has the groove 16 can be considered to belong to the central portion. At either side of the central portion 19 are two side portions 20, each one divided into a fastener 21 with an attachment hole 22 and a reduced portion 23 which generally provides the resilient function of the leaf spring 15. By the shape of the leaf spring, the arm and the tip will be stably positioned laterally, and this condition will prevail also after long use.

As seen in FIGS. 1 and 2, the central portion 19 of the leaf spring is bent to an angle in corresponding manner as the arm 10. The outermost part of the central portion 19 is associated with an armature 24, which can be fastened to the leaf spring in any suitable manner, for example by rivets. The armature of FIG. 2 is wedge-shaped but may of course be of other suitable shape depending on the type of electromagnet to be used as operating means for the arm.

When the armature 24 is attracted by an electromagnet, the arm 10 turns about the reduced portion 23 of the leaf spring so that the tip 14 moves upwards in FIG. 2. To ensure sufficient stiffness of the arm 10 in the direction of pivoting the arm has a reinforcing portion 25. Thus the arm can be of a thin material by which its weight will be very small. The arm can for example be of plastics reinforced by glass fibre. The arm 10 can be attached to the leaf spring 15 by any known method, for instance soldering or welding.

Figure 3:
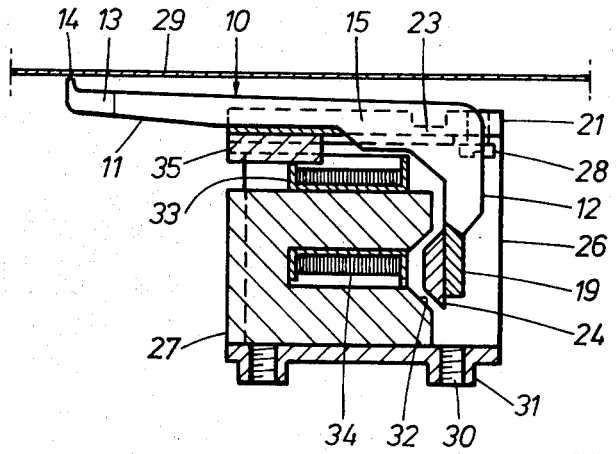

In the embodiment according to FIG. 3 the leaf spring 15 with the arm 10 is attached by the fastener 21 to a frame 26 connected with a magnet core 27. As shown in the Figure, screws 28 can be used for the fastening. The attachment holes can be such that it is possible by the screws 28 or other suitable attachment means to adjust the position of the tip 14 relative to a point on a surface 29 of an information carrier, for example a sheet of paper or a punch tape. The frame 26 has threaded holes 30 made in fasteners 31 for securing the device to a suitable base.

The magnet core 27 has an air gap 32 the form of which corresponds to that of the armature 24. The magnet core further has a body 33 with a winding 34. By the electromagnet of this construction the armature 24 can be attracted for turning the arm 10 in the plane of the Figure. The tip 14 strikes the surface 29 to punch a hole or make a dot forming part of a character. The device can in known manner be imparted a movement relative to the surface. When the armature under the action of the leaf spring 15 and particularly of the reduced portion 23 returns to the initial position, the arm 10 hits a damper 35, for example a rubber cushion, attached to the frame 26. This prevents rebounding of the arm 10. In the shown device the arm 10 is very easily movable due to the fact that it is supported by the leaf spring, whereby there will be no friction.

Figure 4:
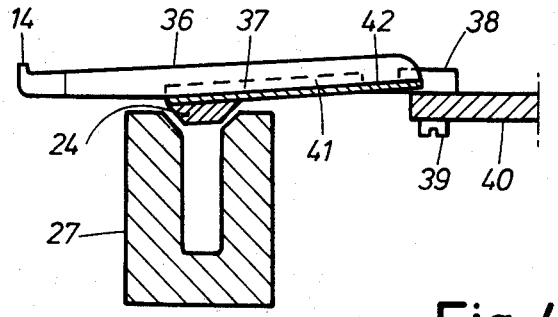

In the embodiment according to FIG. 3 printing or punching is effected when the electromagnet is energized, the magnet having a pulling action. FIG. 4 shows diagrammatically another embodiment of the invention in which the electromagnet has instead a releasing action.

The device according to FIG. 4 comprises an arm 36 and a leaf spring 37 of a construction somewhat different from the one disclosed above. The arm is attached to the leaf spring which in turn, by a fasterner 38 and a screw 39, is attached to a support 40, which as before can be a frame of a magnet core 27. The arm 36, which has a tip 14, ia as before secured to the leaf spring by a groove 41. Between the tip 14 and the fastener 38 the leaf spring has an armature 24 coacting with the magnet core 27, which in the same manner as above has a winding, not shown.

In FIG. 4, the device is shown in idle position which means that the armature 24 is attracted by the electromagnet, the arm 36 with the tip 14 being turned from the surface of the carrier. As before the turning occurs at a resilient, reduced portion 42. When printing or punching is to be effected the electromagnet receives an impulse and thus releases the armature 24. Under the action of the resilient force of the leaf spring 37 the tip 14 falls unto the surface so that a dot or a hole is formed. Meanwhile the electromagnet has again been energized so that the armature is again attracted to the magnet core 27.

A device according to the invention permits considerable freedom in the design of the tip 14, which can be for instance circular, rectangular or elongated depending on the type of characters to be produced or the type of holes to be punched. Also the armature 24 and the magnet core 27 can be of many different designs. Also then there is great freedom in the design and thus it is possible to have a very light armature.

The embodiments shown above do not limit the invention to any extent. Several modifications are thus conceivable within the scope of the following claims.

What is claimed is:

1. Device for point contact on an information carrier comprising:

a. a frame, b. an electromagnet, c. an armature, d. a leaf spring having said armature mounted thereon, e. an elongated L-shaped arm formed by two generally perpendicular legs, the outer end of one of said legs being provided with means for engaging said information carrier, f. the electromagnet co-acting with said armature for moving said other of said legs toward said electromagnet and moving said means on the outer end of said one leg toward said information carrier to provide a dot thereon, and g. said leaf spring of a generally triangular shape being secured to an inner portion of said one leg, the apex of said triangular-shaped spring being directed toward the means for engaging said information carrier, the base opposite said apex being secured to said frame which is fixed relative to said electromagnet, said leaf spring having a portion of reduced thickness located between said apex and said base for providing the resilient function of said spring.

2. Device according to claim 1 characterized in that at least part of the entire electromagnet is disposed within the angle formed by the legs of the L-shaped arm.

3. Device according to claim 2, characterized in that the leaf spring is attached to the frame by securing means, said securing means being adjustable to change the position of the element relative to the contact point at the surface of said information carrier.

4. Device according to claim 1, characterized in that the leaf spring has at least one groove accomodating part of the arm.

* * * * *